US007141098B2

(12) United States Patent
Zhang et al.

(10) Patent No.: US 7,141,098 B2
(45) **Date of Patent: *Nov. 28, 2006**

(54) AIR FILTRATION SYSTEM USING POINT IONIZATION SOURCES

(75) Inventors: Zhiqun Zhang, Roseville, MN (US); Robert M. Swinehart, Marine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 346 days.

This patent is subject to a terminal disclaimer.

(21) Appl. No.: 10/763,835

(22) Filed: Jan. 22, 2004

(65) Prior Publication Data

US 2005/0160907 A1 Jul. 28, 2005

(51) Int. Cl.
*B03C 3/36* (2006.01)

(52) U.S. Cl. ..... 96/62; 96/63; 96/77; 96/97

(58) Field of Classification Search ..... 96/47, 96/50, 55–63, 77, 96, 97
See application file for complete search history.

(56) References Cited

U.S. PATENT DOCUMENTS

| | | | | |
|---|---|---|---|---|
| 3,550,257 | A | 12/1970 | Brown et al. | 96/66 X |
| 3,768,258 | A | 10/1973 | Smith et al. | 60/275 |
| 3,783,588 | A | 1/1974 | Hudis | 55/DIG. 39 |
| 4,234,324 | A | 11/1980 | Dodge, Jr. | 55/DIG. 5 |
| 4,244,710 | A | 1/1981 | Burger | 95/69 |
| RE30,782 | E | 10/1981 | Van Turnhout | 264/DIG. 48 |
| 4,313,741 | A | 2/1982 | Masuda et al. | 96/78 |
| 4,376,642 | A | 3/1983 | Verity | 55/467 X |
| RE31,285 | E | 6/1983 | Van Turnhout et al. | 55/DIG. 39 |
| 4,468,056 | A | 8/1984 | Kramer et al. | 285/281 |
| 4,477,263 | A | 10/1984 | Shaver et al. | 95/7 |
| 4,588,423 | A | 5/1986 | Gillingham et al. | 96/43 |
| 4,643,745 | A | 2/1987 | Sakakibara et al. | 96/76 |
| 4,689,056 | A | 8/1987 | Noguchi et al. | 96/79 |
| 4,734,105 | A | 3/1988 | Eliasson et al. | 95/62 |
| 5,055,115 | A | 10/1991 | Yikai et al. | 96/59 |
| 5,268,009 | A | 12/1993 | Thompson et al. | 96/67 |
| 5,332,425 | A | 7/1994 | Huang | 96/26 |
| 5,405,434 | A | 4/1995 | Inculet | 96/54 |
| 5,407,469 | A | 4/1995 | Sun | 96/62 |
| 5,667,563 | A | 9/1997 | Silva, Jr. | 96/50 |
| 5,707,428 | A | 1/1998 | Feldman et al. | 96/54 |
| 5,855,652 | A | 1/1999 | Talley | 96/44 |
| 5,925,170 | A | 7/1999 | Nojima | 96/71 |

(Continued)

FOREIGN PATENT DOCUMENTS

EP 1 101 533 A2 5/2001

(Continued)

*Primary Examiner*—Richard L. Chiesa
(74) *Attorney, Agent, or Firm*—William J. Bond

(57) ABSTRACT

A filtration system for filtering particulates from air. A plurality of point ionization sources are positioned in the proximity of the periphery of an air flow channel and being oriented to generate ions in the proximity of the air flow channel in a direction generally upstream from each respective one of the plurality of point ionization sources. A particulate collection surface is positioned within the air flow channel in a downstream direction from the plurality of point ionization sources. The particulate collection surface is electrostatically charged in an opposite direction with respect to ground than the electrical charge of the ions. An ion trap is positioned within the air flow channel between the plurality of ionization sources and the particulate collection surface. The ion trap is relatively electrically neutral as compared with the particulate collection surface and the ions.

13 Claims, 6 Drawing Sheets

U.S. PATENT DOCUMENTS

| | | | | |
|---|---|---|---|---|
| 5,961,693 | A | 10/1999 | Altman et al. | 95/78 |
| 5,980,614 | A | 11/1999 | Loreth et al. | 96/63 |
| 6,280,824 | B1 | 8/2001 | Insley et al. | 55/521 X |
| 6,471,746 | B1 | 10/2002 | Hagglund et al. | 95/78 |
| 6,758,884 | B1 * | 7/2004 | Zhang et al. | 96/50 |
| 2002/0005116 | A1 * | 1/2002 | Hagglund et al. | 95/79 |
| 2002/0051161 | A1 | 5/2002 | Kanazawa et al. | 358/1.12 |

FOREIGN PATENT DOCUMENTS

| | | |
|---|---|---|
| FR | 877056 | 11/1942 |
| JP | 56-10312 | 2/1981 |
| JP | 56-10313 | 2/1981 |
| JP | 56-10314 | 2/1981 |
| JP | 7-144108 | 6/1995 |
| JP | 7-241491 | 9/1995 |
| JP | 10-174823 | 6/1998 |
| WO | WO 99/65593 | 12/1999 |
| WO | WO 00/44472 | 8/2000 |
| WO | WO 02/42003 A1 | 5/2002 |

* cited by examiner

AIR FILTRATION SYSTEM USING POINT IONIZATION SOURCES

TECHNICAL FIELD

This invention relates to air filtration systems using ionized air and, especially, to air cleaning systems using a plurality of point ionization sources in a room environment.

BACKGROUND

One type of prior art clean air filtration system employs an ionizer to create ions which attach themselves to dust and dirt particles. The charged particles are then collected such as in a filter or an electrostatic precipitator. The efficiency of such a system depends heavily on the effectiveness of the ionizer to create charged particles which can then be collected.

Traditionally, two types of ionizers have been used in clean air filtration systems (room purifiers) to enhance the performance of the filter used to collect dust and dirt particles.

One type of ionizer consists of a plurality of wires and ground plates. When a high voltage is applied to the plurality of wires, the electric field created between the wires and plates breaks down air molecules, creating large numbers of ions. The ions move to the ground plates at very high speed and collide with dust and dirt particles in the air, transferring electrostatic charges to the dust and dirt particles. These wire-plate type of ionizers are usually disposed upstream of a filter system to pre-charge dust and dirt particles for collection in the filter system. While an effective mechanism for charging particles, this type of ionizer is expensive to construct, requires a high operating current, making it expensive to operate, and is a potential safety hazard due to the very high voltages and high currents employed. This type of ionizer is commonly used in controlled air spaces such as furnace and air conditioning ducts.

Another type of ionizer, which is widely used in room air cleaners or purifiers, is a point ionizer. In a point ionizer, a high voltage, but a much lower current than is typically used in a wire-plate type ionizer, is applied to a point electrode or electrodes to create ions. Again, these ions charge particles of dust and dirt and thereby enhance the performance of a filter.

It is typical of these cleaners or purifiers for the point ionizers to be positioned at or near the exit of the air passing through the cleaners or purifiers. Typically, this is done to disperse ionized particles throughout the room. At least some of these ionized particles would then find their way back to the inlet of the cleaners or purifiers and aid in the operation of the cleaners or purifiers.

An example of an exit point ionizer is U.S. Pat. No. 4,376,642, Verity, Portable Air Cleaner Unit, which describes a portable air cleaner unit. An air mover such as a fan is disposed downstream of the main filter, and an exposed negative ion source is disposed downstream of the fan on the external surface of the air outlet. The main filter consists of fibers shredded from a non-carcinogenic plastic membrane which has been permanently electrostatically charged. The negative ion source ionizes the cleaned air as it leaves the cabinet.

Another example of an exit point ionizer is U.S. Pat. No. 5,268,009, Thompson et al, Portable Air Filter System, a portable air filter system for use in the home, offices, or other areas where it is desired to remove airborne particulate matter from the air. The air filter system includes an ionizer for supplying negative ions to the air exiting through the outlet. The ions charge foreign particles in the air. As a result, when the charged foreign particles are drawn into the inlet of the system, the particles are retained on the filter medium.

Still another example of an exit point ionizer U.S. Pat. No. 5,332,425, Huang, Air Purifier, which describes an air purifier having an extended and tapered discharging copper needle is electrically coupled to a high voltage generator contained within the purifier housing and produces negative ions. The discharging needle is pointed in contour and has an apex end located adjacent the air exit opening. The discharging needle extends in the direction of the passage of high pressure air from the purifier housing which allows the discharging needle to vibrate responsive to the high pressure air flow and increases the amount of negative ions mixed with the air passing from the purifier housing.

These exit ionizers are very effective at charging particles, and has much lower cost and little safety hazard. However, point ionizer systems typically are positioned at the air exit of the purifier, i.e., downstream of the filter. With exit air ionizers, charged particles are discharged into room air, and stay in the air for a significant amount of time before being re-circulated through the filter. As a result, a significant number of these charged particles are removed by other external surfaces such as walls, carpets, human bodies and furniture surfaces, instead of the filter.

Other ionizing filtration systems use point source ionizers at or near the air inlet to the filtration system. Typically, these filtration systems are designed to either disperse ions throughout the room, as do exit ionizers, or are designed to inject ions directly into the air stream within the air inlet of the filtration system.

An example of the type of air cleaning apparatus which diffuses ions throughout the room is shown in U.S. Pat. No. 5,980,614, Loreth et al, Air Cleaning Apparatus, which describes an air cleaning apparatus, especially for cleaning of room air. The device includes an ionizing device having a unipolar ion source formed by a corona discharge electrode, an electrostatic precipitator connected to a high-voltage source and having a flow-through passageway for air to be cleaned and two groups of electrode elements of one group being interleaved with and spaced from the electrode elements of the other group and arranged to be a potential different from that of the other group. While the corona discharge electrode is positioned near the air inlet to the apparatus, the corona discharge electrode is arranged such that the ions generated at the electrode can diffuse essentially freely away from the electrode and thereby diffuse substantially freely throughout the room in which the ionizing device is positioned. As such, the apparatus described in Loreth et al suffers from many of the same disadvantages as the exit ionizers discussed above.

Air filtration systems which are designed to inject ions directly into the air stream at or near the air inlet of the air filtration system or with the internal air stream of the filtration system typically do not achieve optimum efficiency in air cleaning. Typically, in these systems the number of ions generated and the ability of the ions generated to attach to particles of dust and dirt are limited both by the proximity of the ion generation source to the ion collector and by the limited length of time in which the ions have to attach to particles of dust and dirt in the air flow stream within the filtration system.

Thus, while many prior art systems exist which utilize ion generators, and which utilize point source ionizers, such prior art systems suffer numerous disadvantages as discussed above.

Some prior art air filtration systems utilize a centrifugal fan to move air through the filtration system. While such fans are efficient and are operational over a wide range of pressure drops, centrifugal fans are relatively noisy. As such, centrifugal fans suffer significant disadvantages for use in portable, room air filtration systems. Axial fans are considerably less noisy, deliver a uniform straight airflow and can be made very small but are very sensitive to pressure drops as such their use in filtration systems is limited.

SUMMARY OF THE INVENTION

In its several embodiments, the present invention overcomes many of the disadvantages of prior art air filtration systems. The air filtration system of the present invention achieves a significant improvement in operational efficiency without significantly suffering the disadvantages of contaminating an entire room with charged ions and thereby causing a significant amount of dust and dirt particles to accumulate elsewhere on surfaces within the room such as walls, furniture and even people. In some embodiments, the combination of a channel filter particulate collection surface and an axial fan allows the filtration system to operate with less noise and less power facilitating an ability to operate continually without attendant lowered air flow due to particulate build-up in conventional filter media, with or without ionization as a portable room air filtration system.

In a preferred embodiment, a plurality of point ionization sources are positioned in the proximity of the periphery of the air flow channel and being oriented to generate ions in the proximity of the air flow channel in a direction generally upstream from each respective one of the plurality of point ionization sources. A particulate collection surface is positioned within the air flow channel in a downstream direction from the plurality of point ionization sources. The particulate collection surface is electrostatically charged in an opposite direction with respect to ground than the electrical charge of the ions.

In another embodiment, a plurality of point ionization sources are positioned in the proximity of the periphery of the air flow channel and being oriented to generate ions in the proximity of the air flow channel in a direction generally upstream from each respective one of the plurality of point ionization sources. A particulate collection surface is positioned within the air flow channel in a downstream direction from the plurality of point ionization sources. The particulate collection surface is electrostatically charged in an opposite direction with respect to ground than the electrical charge of the ions. An ion trap is positioned within the air flow channel between the plurality of ionization sources and the particulate collection surface. The ion trap is relatively electrically neutral as compared with the particulate collection surface and the ions.

In a preferred embodiment, the major longitudinal axis of the ionization head is oriented in an orientation angle with respect to the upstream to downstream direction and wherein the orientation angle is not more than sixty degrees inward toward the air flow channel and not more than ninety degrees outward away from the air flow channel.

In a preferred embodiment, the filtration system of the present invention also comprises a plurality of flow channels, one of each of the plurality of flow channels at least partially surrounding at least a portion of each respective one of the plurality of point ionization sources.

In a preferred embodiment, a portion of the air flow which is downstream of the particulate collection surface is directed past the ionization head in a direction generally opposite to the upstream to downstream direction.

In a preferred embodiment, the portion of the air flow is directed through at least one of the plurality of flow channels.

In a preferred embodiment, each of the plurality of flow channels has a major longitudinal axis and wherein the major longitudinal axis of each of the plurality of flow channels is generally parallel to the major longitudinal axis of the ionization head.

In a preferred embodiment, the ionization head comprises a multi-point ionization head.

In a preferred embodiment, the present invention further comprises a fan arranged for operative use with the air flow channel for moving the air in the upstream to downstream direction through the air flow channel.

In another embodiment, the present invention provides a filtration system for filtering particulates from air flowing in an upstream to downstream direction in an air flow channel. A point ionization source is oriented to generate ions in the proximity of the air flow channel, the ions predominately having an electrical charge with respect to ground. A particulate collection surface is positioned within the air flow channel in a downstream direction from the point ionization source, the particulate collection surface being electrostatically charged in an opposite direction with respect to ground than the electrical charge of the ions. A portion of the air flow is directed.

In a preferred embodiment, the portion of the air flow directed past the ionization source in a direction generally opposite to the upstream to downstream direction is air flow which is downstream of the particulate collection surface.

In an alternative embodiment using an axial fan, a filtration system filters particulates from air flowing in an upstream to downstream direction in an air flow channel. A point ionization source, if used, is oriented to generate ions in the proximity of the air flow channel, the ions predominately having an electrical charge with respect to ground. A channel filter particulate collection surface is positioned within the air flow channel in a downstream direction from the optional point ionization source and electrostatically charged in an opposite direction with respect to ground than the electrical charge of the ions. An axial fan is arranged for operative use with the air flow channel for moving the air in the upstream to downstream direction through the air flow channel.

In a preferred embodiment, the axial fan is positioned within the air flow channel.

DETAILED DESCRIPTION

The present invention provides an air filtration system which is relatively inexpensive to produce and which can be used as a portable (e.g., desk top or wall mounted) room air filtration system, and which can be of the type which can be readily used by consumers to filter and clean room air.

In an embodiment, a plurality of ionization sources, positioned upstream of the filter is designed to generate ions outside of the air filtration but which disperse in a relatively small area upstream of the inlet of air filtration system. This allows the ions generated to attach to dust and dirt particles in the air, most of which is then drawn into the air inlet of the filtration system and subsequently collected in the collection mechanism. Thus, efficiencies of operation are achieved without allowing an entire room to be dispersed with ions and thereby created adverse effects such as contamination of room surfaces, such as walls and furniture, with ion charged particles.

The filtration system of the present invention relies on a fan or other air movement device or method to move particulate contaminated gaseous fluid past upstream ionization sources and over or through a downstream particulate collection surface. Thus, the present invention may contain a fan, or other air movement device, or the present invention may be designed to be installed in an environment already containing such an air movement device. In either case, gaseous fluid is passed through the air filtration system in an upstream to downstream direction.

While the air movement device can be located at either the inlet or exhaust ports of the air filtration system, or anywhere in between, it is preferable that the air movement device to be placed downstream of the particulate collection surface to minimize the accumulation of particulate contaminants on the air movement device, such as on fan blades. Suitable fans include, but are not limited to, conventional axial fans or centrifugal fans. Alternatively, particulate contaminated air could be moved through the air filtration system of the present invention through the contaminated air or by simple convection. Air moved by convection currents created by a heat source could be directed through the air filtration system without the need for any mechanical assistance.

Figure 1:
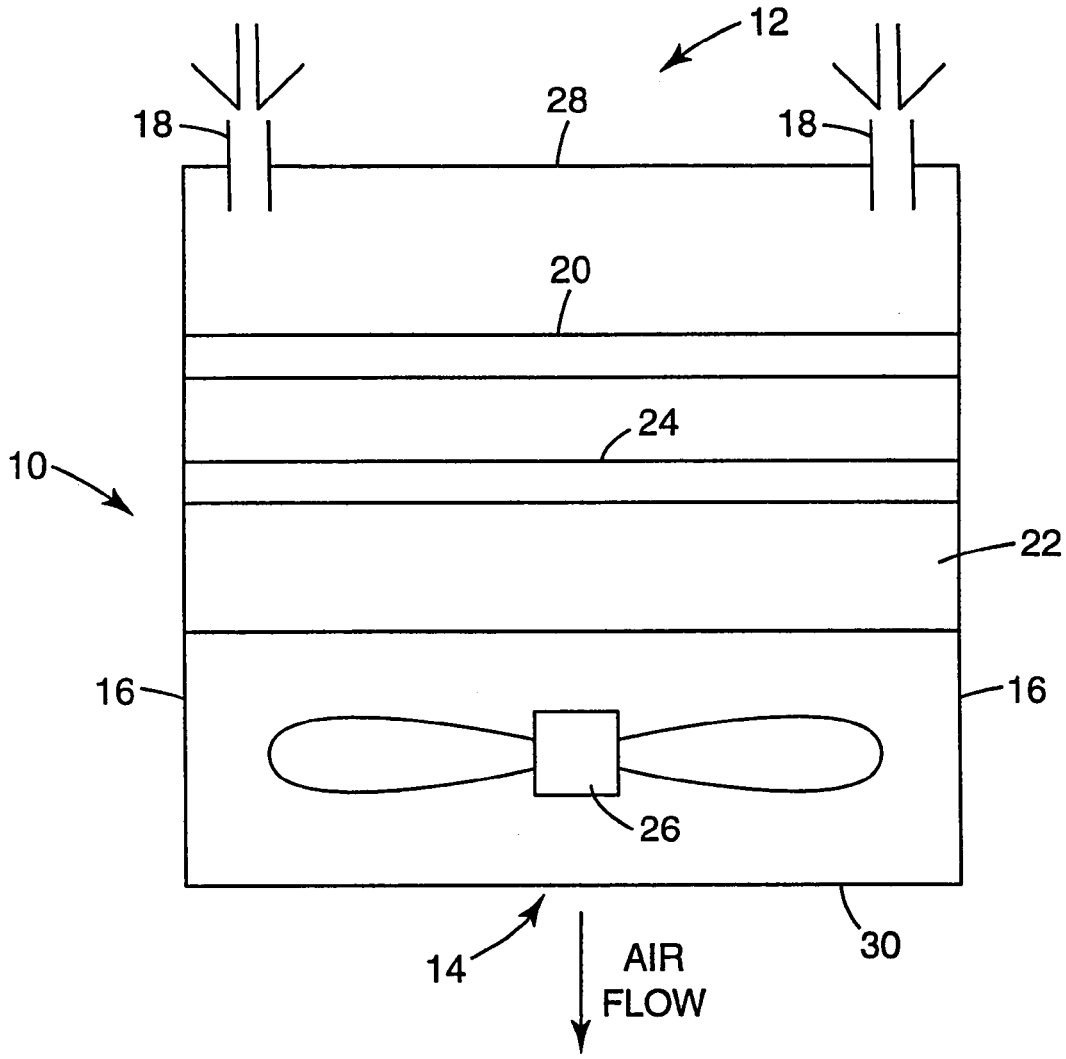
FIG. 1 illustrates a cross-sectional view of one embodiment of the present invention in which cleaner components are positioned ionizer, trap, filter and fan (in an upstream to downstream air flow order)

FIG. 1 illustrates a cross-sectional view of one embodiment an air filtration system 10 of the present invention. Air flows through the air filtration system 10 from the inlet 12 to the exhaust 14. An air flow chamber is formed either by exterior walls 16 of the air filtration system 10 or by environment into which the air filtration system 10 is placed. In the latter case, the air flow chamber could be an existing air duct, such as in an air conditioning system. Generally, air flows through the air filtration system 10 in an upstream to downstream direction from inlet 12 to exhaust 14.

Located in the proximity of the periphery of the inlet 12 are a plurality of point ionization sources 18 which are directed to generate ions generally in an upstream direction from inlet 12. Thus, point ionization sources 18 disperse ions outwardly from air filtration system 10 in front of inlet 12. In preferred embodiments, point ionization sources 18 are angled not more than sixty (60) degrees $\beta$ inward of a pure upstream direction and not more than ninety (90) degrees outward $\alpha$ of a pure upstream direction. Directed in this manner, point ionization sources 18 are capable of generating ions which are dispersed not only across but also out in front of inlet 12 which such ions can become attached to dust and dirt particles in the air.

In a preferred embodiment, point ionization sources 18 consist of multi-point ionization heads and a high voltage power supply. An example of a high voltage power supply which could be utilized is a minus fourteen kilovolt (−14 KV) power supply from Collmer Semiconductor, Dallas, Tex., generating negatively charged ions. The multi-point ionization heads can be made with conductive fibers with a mean fiber diameter of 10 micrometers. An example of such a multi-point ionization heads which could be utilized is model FA1-7-2, manufactured by Fu Fong Enterprises Co., Chung-Li City, Taiwan, Republic of China, operating at 120 volts AC, 50–60 Hertz, producing 7 kilovolts DC negative.

The combination of the plurality of point ionization sources 18, the location of the plurality of point ionization sources 18 and the directionality of point ionization sources 18 allows for the efficient generation of ions, the efficient attachment of ions generated to dust and dirt particles in the air and prevents an entire room from being contaminated with ions with the subsequent result of dust and dirt particles being necessarily deposited on room surfaces such as walls, floors, ceilings and furniture.

An ion trap 20 may be positioned within the air flow steam of air filtration system 10 to trap some the ions passing there through and to help prevent the cloud of ions generated by point ionization sources 18 from dispersing too far outwardly from inlet 12 of air filtration system 10. Ion trap 20 removes excess ions from the air stream and protects the particulate collection surface 22 from neutralization. Positioned in this manner, the utilization of ion trap 20 downstream of point ionization sources 18 further assists in preventing an entire room from being contaminated with ions.

Downstream point ionization sources 18 and, in this embodiment, downstream of ion trap 20 is particulate collection surface 22 which, in this embodiment, is illustrated as a filter. It is to be recognized that particulate collection surface 22 could be a passive filter medium, a charged collection surface or a collection grid, all of which are well known in the prior art. In a preferred embodiment, ion trap 20 is mesh screen of 36 meshes per square inch (5.58 meshes per square centimeter) operatively coupled to electrical ground. Particulate collection surface 22 may be an electrostatically charged channel flow filter.

With their low resistance to airflow and reduced susceptibility to becoming clogged with contamination, channel filters are preferred filter media for used in applications of the invention. Channel filters are constructed in a manner so as to provide an array of relatively open airflow channels that remove particulate matter as the air passes through the channels. As air passes through the channels of the filter, particulate material is deposited and captured on the channel walls. Channel filtration media can be made in a number of configurations and with a range of materials.

Channel filtration media can be directly molded or formed from contoured layers of material arranged in a honeycomb-like structure that has open airflow pathways. Contoured layers, when arranged together to form a channel filter, define a plurality of inlet openings that lead into air pathways through the media. The fluid pathways further have outlet openings which allow air to pass into, through, and out of the media without necessarily passing through a contour layer. The honeycomb-like structure may be formed from fibrous webs, films, or combinations thereof. Channel filters can include extended surface area materials like fine inorganic fibers, polymeric synthetic fibers, papers, and some structured films.

Examples of web-based channel filtration media are described in Japanese Kokai 7-144108 (published Jun. 6, 1995). This publication indicates that it is known to form honeycomb filters (e.g., pleated corrugated filter media resembling corrugated cardboard) from electret charged nonwoven filter media. This patent application discloses increasing the long term efficiency of such a filter structure by forming it from a filter media laminate of charged microfiber filter media and charged split fiber filter media (e.g., similar to that disclosed in U.S. Pat. No. RE 30,782). An alternate construction is described in Japanese Kokai 7-241491 (published Sep. 19, 1995) which discloses a honeycomb filter, as above, where the pleated layers and the flat layers forming the corrugated honeycomb structure are alternating layers of electret charged nonwoven filter media and sorbent filter media (activated carbon loaded sheet or the like), the activated carbon layer preferably formed with a liner (e.g., a nonwoven) that may also be electret charged. Japanese Kokai 10-174823 (published Jun. 30, 1998) discloses another honeycomb type filter where the filter material forming the honeycomb structure is formed from a laminate of an electret charged nonwoven filter layer and an antibacterial filter layer. These honeycomb type filters are advantageous for uses where low airflow resistance is critical and single pass filtration efficiency is less important; for example, re-circulating type filters in applications of the invention.

Channel filtration media formed from polymeric films can provide further improvements in reduction of airflow resistance as compared to web-based structures. Examples of such filters are described in U.S. Pat. No. 3,550,257 where a charged filtration media employs a film rather than a nonwoven media. The charged films are separated by spacer strips that are described as open cell foam webs of glass fibers or corrugated Kraft paper. The pressure drop is described as dependent on the porosity of the spacers and the space between the charged dielectric films.

Japanese Kokai 56-10314 (published Feb. 2, 1981) discloses a structure where a corrugated honeycomb structure is formed with layers formed from a charged polymeric film (defined as a film or a nonwoven). It is disclosed that the film is imparted with "wrinkles" by the folding process. Similar film type honeycomb structures formed from charged films are further disclosed in related Japanese Kokai 56-10312 and 56-10313, both published Feb. 2, 1981.

Channel filtration media that can provide particular utility in application of the invention are those films with extended surface area that are electret charged and surface fluorinated. Extended surface area films have high aspect ratio, small dimension structures such as ribs, stems, fibrils, or other discrete protuberances which extend the surface area of at least one face of the film layer. Like their web counterparts, extended surface area films can benefit from surface fluorination treatments that promote resistance to wetting by low surface tension liquid aerosols that might reduce the particle capture effect afforded by the electret charge. Channel flow filters of this type are exemplified in U.S. Pat. No. 6,280,824 to Insley et al., incorporated herein by reference.

In a preferred embodiment, particulate collection surface 22 is a filter medium such as is described in U.S. Patent Application Publication No. US2002/0005116 A1, Hagglund et al, Electrofiltration Apparatus, assigned to 3M Innovative Properties Company. Hagglund et al discloses an electrofiltration apparatus having an electrostatically charged polymeric film layer having surface structures. The film layers may be configured as a collection cell that has the structured film layer defining a plurality of ordered inlet openings through a face of the collection cell and corresponding air pathways, thereby forming an open, porous volume. The air pathways are defined by a plurality of flow channels formed by the structured film layers.

In another embodiment, particulate collection surface 22 may be a fibrous filter such as a Filtrete™ filter manufactured by 3M Company, St. Paul, Minn., USA.

Alternatively, particulate collection surface 22 may be any of a variety of commonly known filter or other particulate collection devices well known in the art.

Particulate collection surface 22 may be electrostatically charged to an electrical potential which is opposite from the predominate electrical charge of the ions generated by point ionization sources 18 in order to enhance particulate collection.

Optionally, a pre-filter 24 may be disposed immediately upstream of particulate collection surface 22 to partially protect particulate collection surface 22 from excess contamination. Pre-filter 24 may be constructed from any of a variety of well known filter type materials, including an activated carbon web.

In the embodiment illustrated in FIG. 1, fan 26 is positioned within the air flow channel downstream of particulate collection surface 22. In this embodiment, fan 26 is responsible for moving air in an upstream to downstream direction, from inlet 12 to exhaust 14, through air filtration system 10.

Optionally, air filtration system 10 includes an entrance grille 28 positioned at inlet 12 and an exit grille 30 positioned at exhaust 14.

Figure 2:
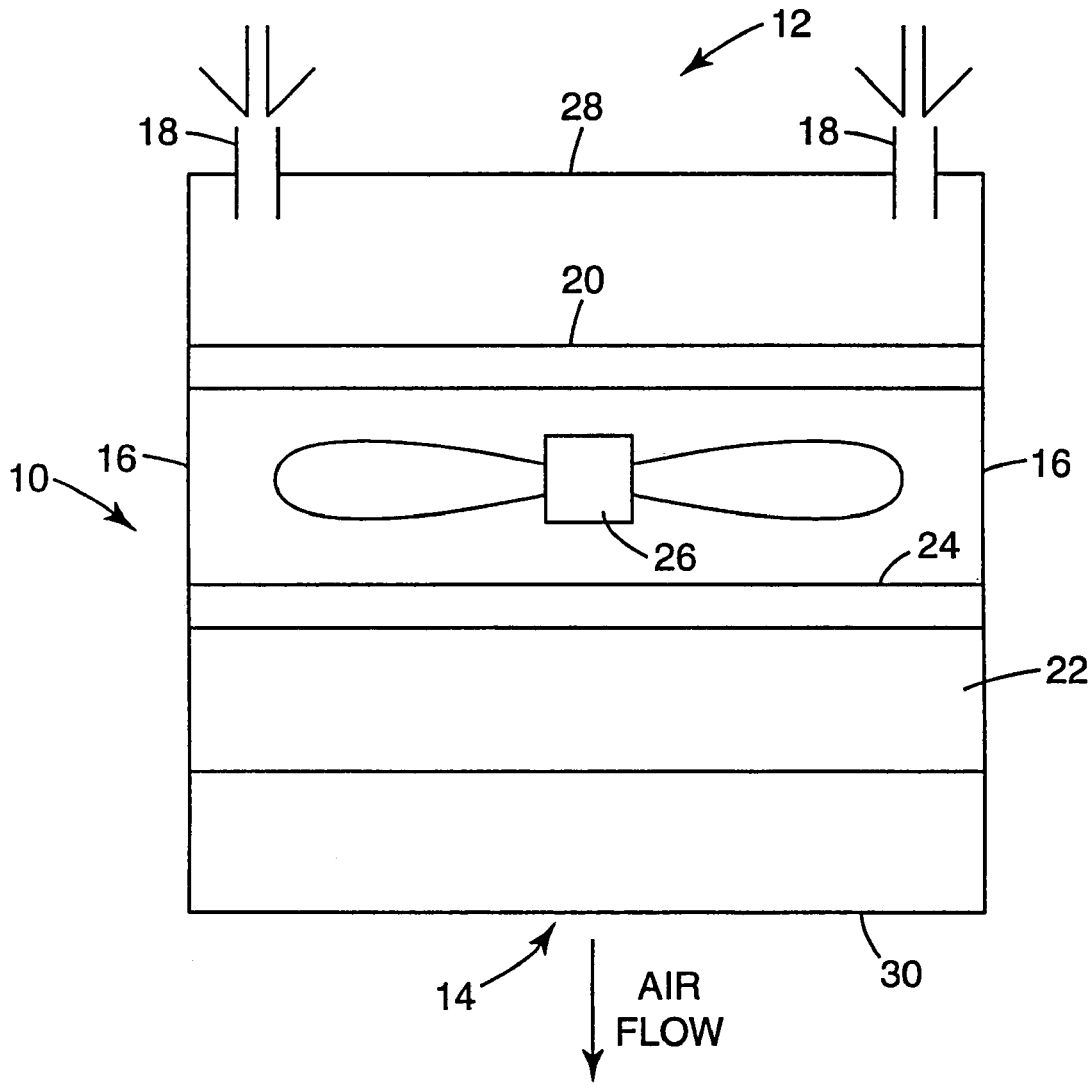
FIG. 2 illustrates a cross-sectional view of another embodiment of the present invention in which cleaner components are positioned ionizer, trap, fan and filter (in an upstream to downstream air flow order)

FIG. 2 illustrated an alternative embodiment of the present invention in which air filtration system 10 contains the same elements as are described in relation to the air filtration system 10 described with respect to FIG. 1 but in a slightly different order. The alternative embodiment illustrated in FIG. 2, fan 26 is moved upstream of particulate collection surface 22 and optional pre-filter 24. Positioned in this manner, fan 26 is still responsible for moving air in an upstream to downstream direction, from inlet 12 to exhaust 14, through air filtration system 10. Although perhaps not as advantageous to the embodiment illustrated in FIG. 1, nevertheless, the embodiment illustrated in FIG. 2 still provides a significant efficiency of operation and effectiveness. While pre-filter 24 and particulate collection surface 22 are shown in FIG. 2 as positioned next to each other in the air flow, it is to be recognized and understood that the pre-filter could be otherwise positioned in the air flow, such as being positioned upstream of fan 26 while particulate collection surface 22 is positioned downstream of fan 26.

Figure 3:
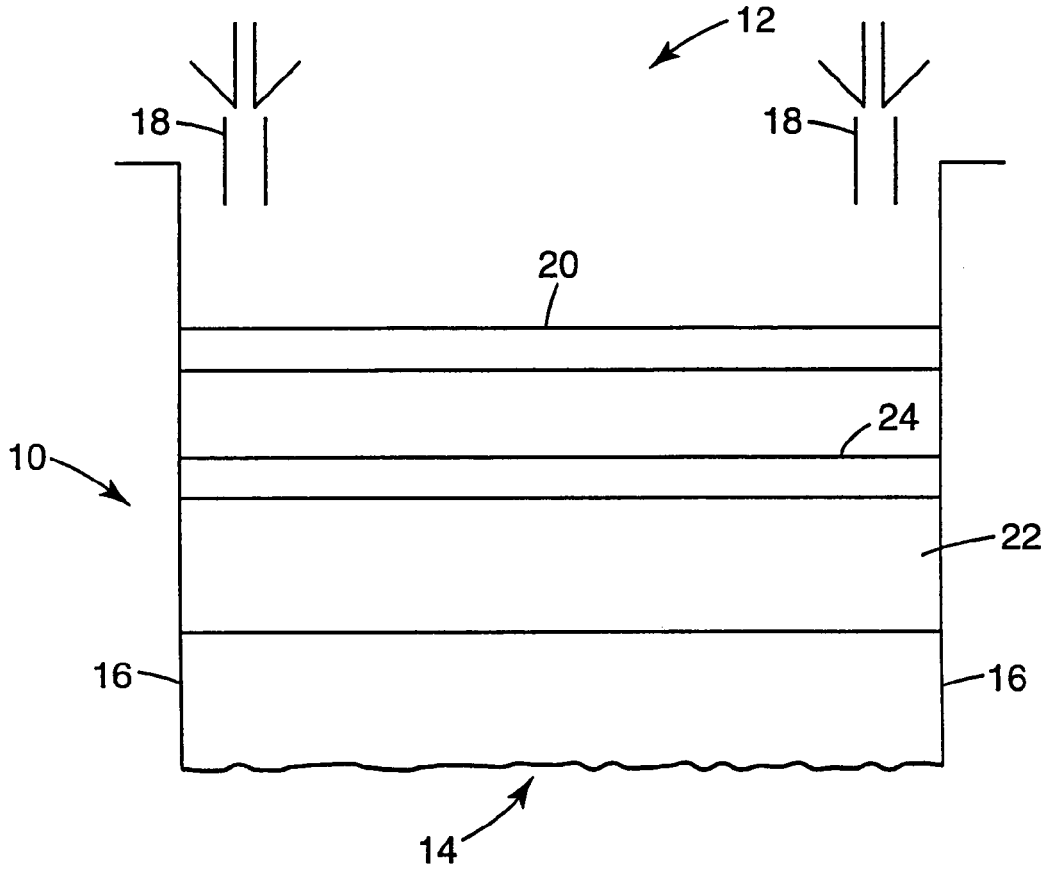
FIG. 3 illustrates a cross-sectional view of another embodiment of the present invention in which cleaner components are positioned ionizer, trap and filter (in an upstream to downstream air flow order)

FIG. 3 illustrates still another embodiment of the present invention. In FIG. 3, air filtration system 10 relies on an existing mechanism for the transport of air flow through air filtration system 10. Thus, the air filtration system 10 illustrated in FIG. 3 may be placed in an existing air flow environment without the necessity of an explicit air flow production device such as fan 26.

In the embodiment illustrated in FIG. 3, air filtration system 10 is located near the inlet 12 of an existing air flow environment. An example of an existing air flow environment is an air conditioning system such as in a building. In such an environment, air filtration system 10 could be located in a position near an inlet 12 of air into an air flow channel. Such an inlet 12 could be an air return register which collects building air and returns it to the air conditioning system. Exhaust 14 in this embodiment could simply be the passage of the air from air filtration system 10 to the remainder of the existing air flow environment, or existing ducts of the existing air conditioning system. In this embodiment, exterior walls 16 could be the existing walls of the existing air flow environment such as the existing ducts of the existing air conditioning system.

Figure 4:
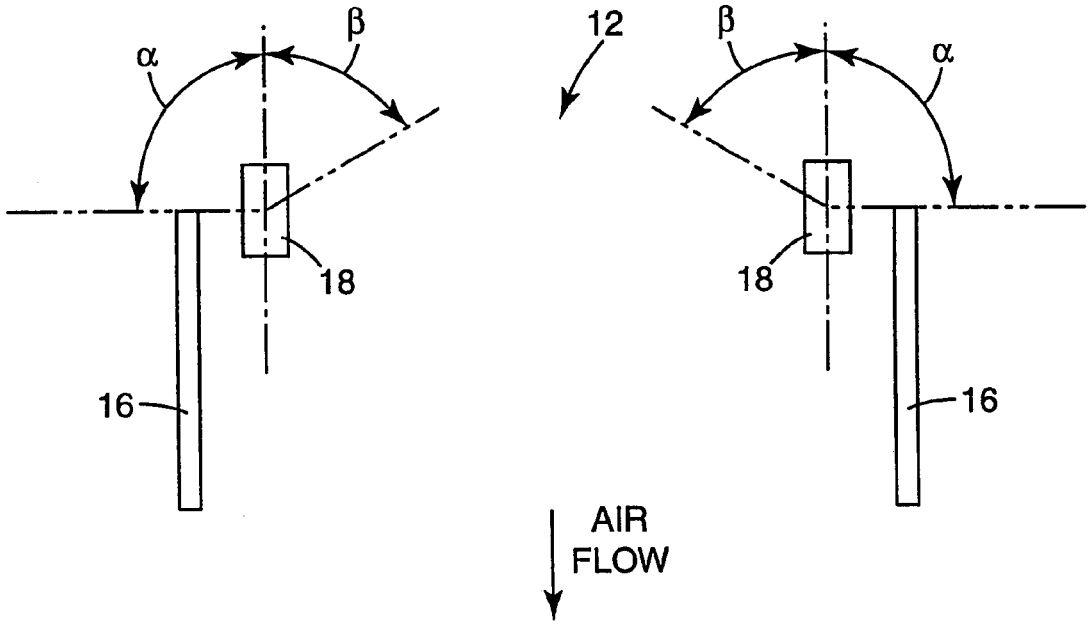
FIG. 4 illustrates a close-up view of the preferred angles of orientation of the ionizers in preferred embodiments of the present invention.

FIG. 4 is a close-up detail of point ionization sources 18 illustrating preferred angles of orientation point ionization sources 18. As discussed above, point ionization sources 18 should be positioned near the periphery of inlet 12 of air filtration system 10. Moreover, point ionization sources 18 should be oriented in an angle to predominately generate ions immediately in the proximity of inlet 12 upstream from inlet 12 as determined from the direction of air flow through air filtration system 10. A preferred angle of orientation has point ionization sources 18 having an axial dimension oriented directly upstream of the air flow through air filtration system 10. This orientation would direct the predominate number of ions generated upstream of inlet 12. Alternative angles of orientation include inward angles of not more than sixty (60) degrees β with respect to the upstream direction. Oriented more than sixty (60) degrees inward does not typically result in the generation of enough ions upstream of inlet 12 so as to efficiently aid in the collection of dust and dirt particles in the air filtration system 10. In particular, cross flow ionizers, where the angle of orientation is ninety (90) degrees α inward, result in the inefficient generation of ions.

Alternatively, point ionization sources 18 could be angled outwardly with respect to the upstream direction to not more than ninety (90) degrees. It has been found outward angles of orientation of greater than ninety (90) degrees result in a predominate generation of ions in a downstream direction, and outside of the air flow channel in air filtration system 10. This results in a predominate saturation of the room environment with ions and the resulting disadvantages of such saturation discussed above. However, outward angles of orientation up to ninety (90) degrees have been found to predominately result in the generation of ions in an upstream direction, especially when coupled with movement of air flow through air filtration system 10 with air being drawn into air filtration system 10 through inlet 12. It is preferred that point ionization sources 18 be oriented outwardly with respect to the upstream direction.

Of course, the angle of orientation of one of the plurality of point ionization sources 18, could be different from the angle of orientation of another of such plurality of point ionization sources 18. For example, one of the plurality of point ionization sources 18 could be oriented directly in an upstream direction (an angle of zero (0) degrees as illustrated in FIG. 4) while another of the plurality of point ionization sources 18 could be oriented inwardly at an angle of forty-five (45) degrees. Such a mix of angles of orientation may be desirable, for example, in specific room configurations.

Figure 5:
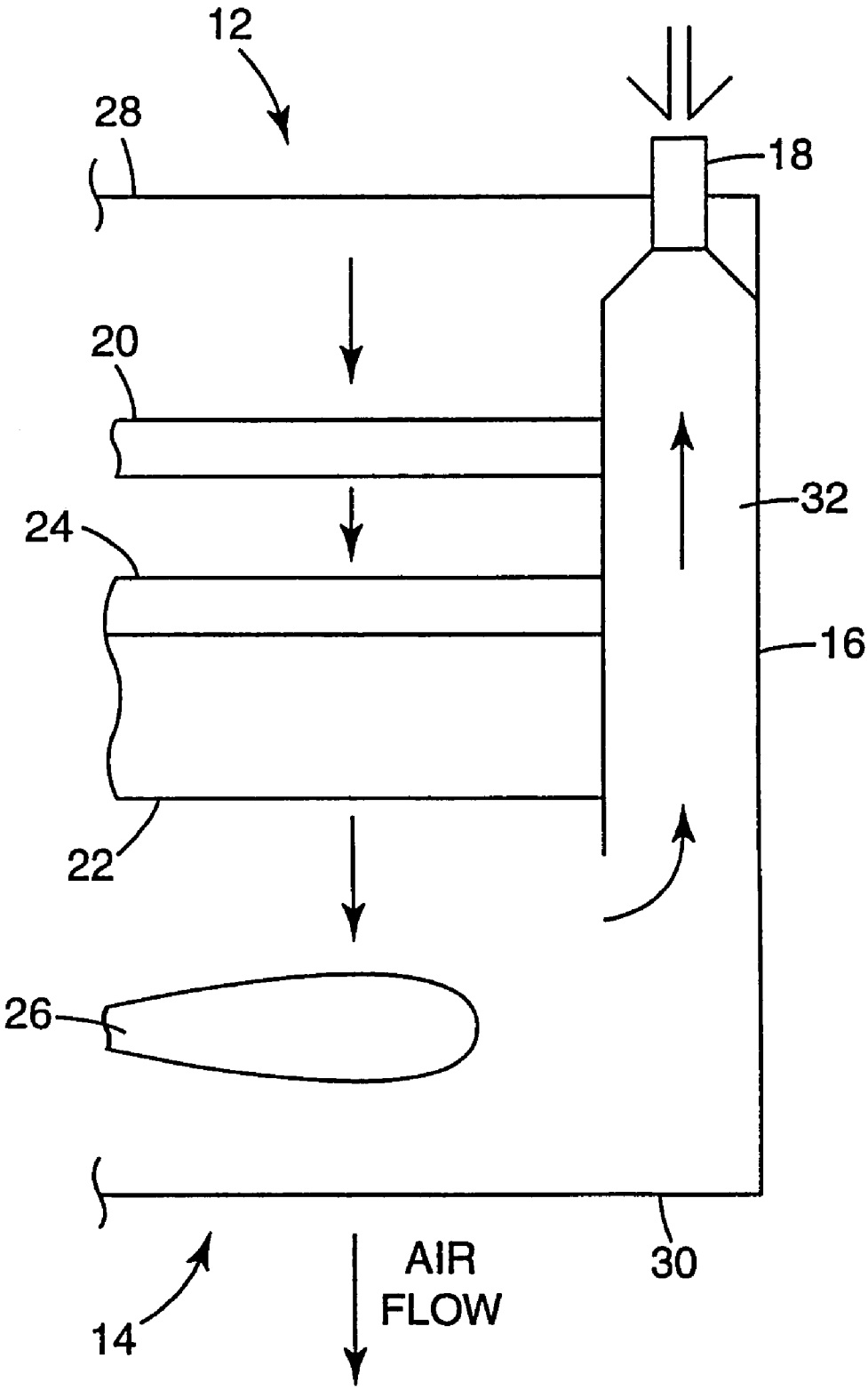
FIG. 5 illustrates a detail view of ionizer tip air flow in one embodiment of the present invention.

FIG. 5 illustrates a close-up view of a portion of a cross-section of an alternative embodiment of air filtration system 10. Air filtration system 10 of FIG. 5 is similar to the air filtration system 10 illustrated in FIG. 1 in that air filtration system 10 has an inlet 12 at the upstream end of air filtration system 10 with air flow through air filtration system 10 in a downstream direction through optional entrance grille 28, point ionization source 18 (only one shown in FIG. 5), ion trap 20, particulate collection surface 22, optional fan 26 and optional exit grille 30. However, the embodiment of air filtration system 10 illustrated in FIG. 5 additionally includes an air flow channel 32 which directs air in an upstream direction across or by point ionization source 18. Such an air flow channel may be constructed in any manner either internal or external to the air flow channel of air filtration system 10. Such an air flow channel may utilize air passing through the air flow channel of air filtration system 10 or may utilize air from a separate source. In a preferred embodiment, a portion of the air flow channel of air filtration system 10 is walled off by wall 34 to funnel a portion of air drawn through the air flow channel back upstream and directly past point ionization source 18. Since air taken from the downstream side of particulate collection 22 is under pressure with respect the ambient air pressure of the room in which air filtration system 10 is located, air may pass upstream past point ionization source 18 without additional mechanical assistance. Of course, it is to be recognized and understood that other mechanisms of passing air over point ionization source 18 in an upstream direction are envisioned including those utilizing a separate source of mechanical assistance. Air passing over point ionization source 18 helps to not only disperse ions in an upstream direction from inlet 12 but, perhaps even more significantly, aids in preventing the build-up of particulate matter on point ionization source 18 keeping point ionization source 18 clean and more efficient.

Figure 6:
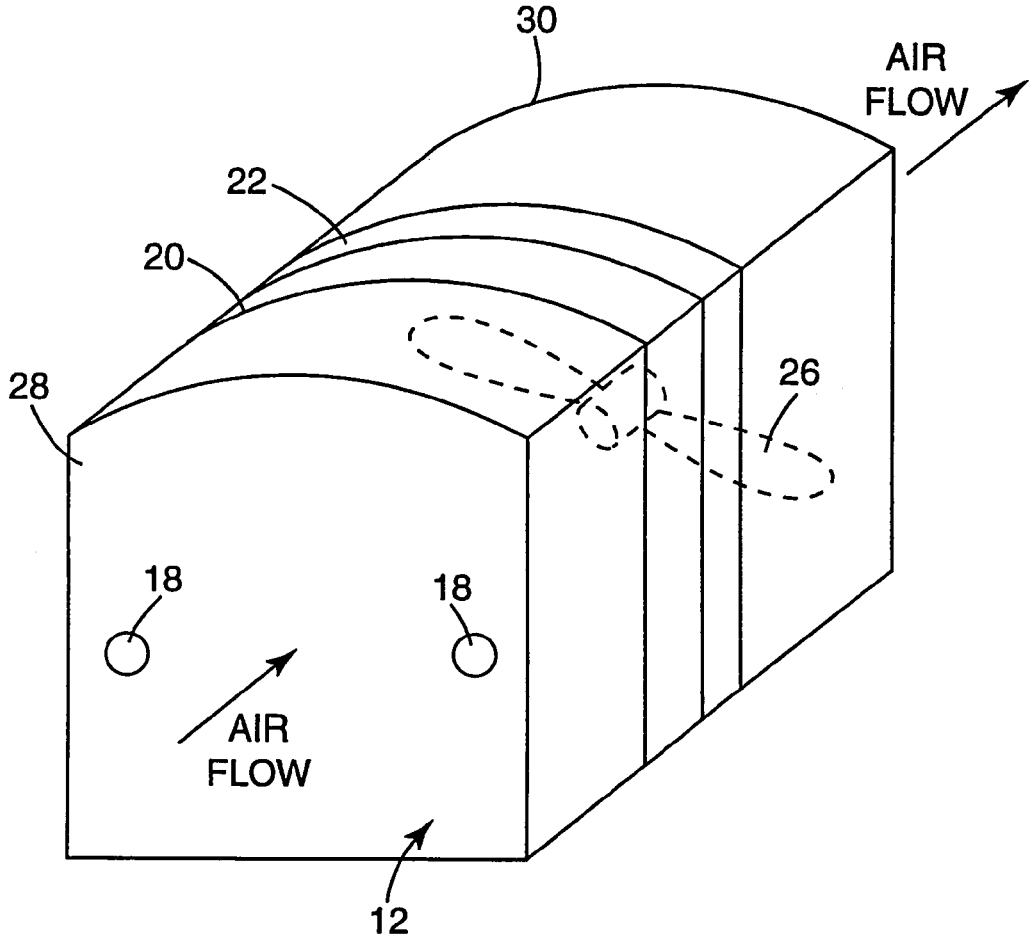
FIG. 6 illustrates a perspective exploded view of a preferred embodiment of the present invention.

FIG. 6 is an illustration of the air filtration system 10 of FIG. 1 shown in a perspective view. Air flow through air filtration system 10 is from an upstream direction from entrance grille 28 through to exit grille 32. Point ionization sources 18 are positioned near the periphery of inlet 12 and predominately direct generated ions in an upstream direction away from inlet 12. Ion trap 20 is positioned downstream of inlet 12 to limit the proliferation of ions throughout the room. Particulate collection surface 22 is positioned downstream of ion trap 20 to collect particulate matter which has become attached to ions passing through air filtration system 10. Fan 26 provides mechanical assistance for the air flow through air filtration system 10.

While air filtration system 10 has been described and illustrated in the above embodiments as having two point ionization sources 18, it is to be recognized and understood that other embodiments are contemplated that have a plurality of point ionization sources 18 in excess of two. In particular, the number of point ionization sources 18 may be any number equal to or greater than two. Of course, while additional benefits may be achieved by employing additional point ionization sources 18, the additional benefits achieved by adding one more point ionization source 18 decreases as the number of point ionization sources 18 increases. Thus, the cost benefit ratio of additional point ionization sources 18 eventually is expected to decline as the number of point ionization sources 18 is increased.

In a preferred embodiment, point ionization sources 18 have ionizer heads which are recessed five (5) millimeters behind the outside surface of entrance grille 28. In an alternative embodiment, ionizer heads of point ionization sources 18 are recessed ten (10) millimeters behind the outside surface of entrance grille 28. It is preferred that the diameter of the hole in entrance grille 28 where ionizer heads are recessed have a diameter of eight (8) millimeters. In an alternative embodiment, the diameter of the hole in entrance grille 28 where ionizer heads are recessed have a diameter of twenty (20) millimeters.

In a preferred embodiment, air filtration system 10 is constructed by modifying a commercially available air purifier, namely the Pollenex Model PA115, available from Pollenex, The Holmes Group, Milford, Mass. The original fan 26 is replaced with a Dayton 105 CFM AC axial fan 4WT47 available from Dayton Electric Manufacturing, Niles, Ill. The point ionization sources 18 are mounted symmetrically with respect to the centerline, i.e., the z-axis, the front face of air purifier. The point ionization sources 18 are electrically insulated and the point ionization sources 18 and ion trap 20 are electrically separated. The ion trap 20 is electrically grounded.

Two types of point ionization sources 18 are preferred, a needle point electrode and a fibrous electrode. The needle point electrode is a tungsten needle with a 40 micrometer diameter tip point. The fibrous electrode is made of conductive fibers with a mean fiber diameter of 10 micrometers.

Preferred particulate collection surfaces 22 are electrostatically charged filter media such as is described in U.S. Patent Application Publication No. US2002/0005116 A1 or Filtrete™ fibrous media manufactured by 3M Company, St. Paul, Minn. Of course, other forms of electrostatically charged filter media are contemplated and may be used in the present invention.

Various modifications and alterations of this invention will be apparent to those skilled in the art without departing from the scope and spirit of this invention. It should be understood that this invention is not limited to the illustrative embodiments set forth above.

What is claimed is:

1. A filtration system for filtering particulates from air flowing in an upstream to downstream direction in an air flow channel, comprising:

a plurality of point ionization sources, each of said plurality of point ionization sources located in the proximity of the periphery of said air flow channel and being oriented to generate ions in the proximity of said air flow channel in a direction generally upstream from each respective one of said plurality of point ionization sources, said ions predominately having an electrical charge with respect to ground; and a particulate collection surface positioned within said air flow channel in a downstream direction from said plurality of point ionization sources, said particulate collection surface electrostatically being permanently electret charged in an opposite direction with respect to ground than said electrical charge of said ions.

2. A filtration system as in claim 1 wherein each of said plurality of point ionization sources comprises an ionization head having a major longitudinal axis.

3. A filtration system as in claim 2 in which said major longitudinal axis of said ionization head is oriented in an orientation angle with respect to said upstream to downstream direction and wherein said orientation angle is not more than sixty degrees inward toward said air flow channel and not more than ninety degrees outward away from said air flow channel.

4. A filtration system as in claim 2 wherein said ionization head comprises a multi-point ionization head.

5. A filtration system as in claim 1 further comprising a fan arranged for operative use with said air flow channel for moving said air in said upstream to downstream direction through said air flow channel.

6. A filtration system as in claim 1 wherein said particulate collection surface comprises a filter.

7. A filtration system for filtering particulates from air flowing in an upstream to downstream direction in an air flow channel, comprising:

a point ionization source being oriented to generate ions in the proximity of said air flow channel, said ions predominately having an electrical charge with respect to ground; and a particulate collection surface positioned within said air flow channel in a downstream direction from said point ionization source, said particulate collection surface being permanently electret charged in an opposite direction with respect to ground than said electrical charge of said ions;

a portion of said air flow being directed past said ionization source in a direction generally opposite to said upstream to downstream direction.

8. A filtration system as in claim 7 wherein said portion of said air flow is air flow which is downstream of said particulate collection surface.

9. A filtration system as in claim 7 which further comprises a flow channel at least partially surrounding at least a portion of said point ionization source.

10. A filtration system as in claim 9 in which said portion of said air flow is directed through said flow channel.

11. A filtration system as in claim 7 wherein said point ionization source comprises a multi-point ionization head.

12. A filtration system as in claim 7 further comprising a fan arranged for operative use with said air flow channel for moving said air in said upstream to downstream direction through said air flow channel.

13. A filtration system as in claim 7 wherein said particulate collection surface comprises a filter.

* * * * *

UNITED STATES PATENT AND TRADEMARK OFFICE

CERTIFICATE OF CORRECTION

PATENT NO. : 7,141,098 B2
APPLICATION NO. : 10/763835
DATED : November 28, 2006
INVENTOR(S) : Zhiqun Zhang It is certified that error appears in the above-identified patent and that said Letters Patent is hereby corrected as shown below:

Col. 9, Line 48: ""18"" should be known as -- 18 --

Col. 11, Line 42: in Claim 1, after "surface" delete "electrostatically"

Signed and Sealed this

Twenty-fourth Day of April, 2007

JON W. DUDAS
*Director of the United States Patent and Trademark Office*